US008671605B2

(12) United States Patent
Siddle et al.

(10) Patent No.: US 8,671,605 B2
(45) Date of Patent: Mar. 18, 2014

(54) OFF-TRIGGER LOCATOR

(71) Applicants: Bruce K. Siddle, Millstadt, IL (US); David A. Grossman, Mascoutah, IL (US); Jonathon D. Grossman, Mascoutah, IL (US)

(72) Inventors: Bruce K. Siddle, Millstadt, IL (US); David A. Grossman, Mascoutah, IL (US); Jonathon D. Grossman, Mascoutah, IL (US)

(73) Assignees: Bruce K. Siddle, Mascoutah, IL (US); David A. Grossman, Mascoutah, IL (US); Jonathon D. Grossman, Mascoutah, IL (US)

( * ) Notice: Subject to any disclaimer, the term of this patent is extended or adjusted under 35 U.S.C. 154(b) by 0 days.

(21) Appl. No.: 13/632,565

(22) Filed: Oct. 1, 2012

(65) Prior Publication Data

US 2014/0047750 A1 Feb. 20, 2014

Related U.S. Application Data

(63) Continuation-in-part of application No. 13/588,690, filed on Aug. 17, 2012, and a continuation-in-part of application No. 13/588,743, filed on Aug. 17, 2012.

(51) Int. Cl.
*F41C 27/00* (2006.01)

(52) U.S. Cl.
USPC ..... 42/1.01; 42/71.01; 42/71.02; 42/85; 42/111; 42/106

(58) Field of Classification Search
USPC ..... 42/1.01, 71.01, 71.02, 72, 85, 90, 106, 42/111
See application file for complete search history.

(56) References Cited

U.S. PATENT DOCUMENTS

| | | | |
|---|---|---|---|
| 189,721 | A | 4/1877 | Freund |
| 607,344 | A | 7/1898 | Cooper |
| 694,969 | A | 3/1902 | Kemp |
| 837,563 | A | 12/1906 | Hartman |
| 1,087,747 | A | 2/1914 | Evans |
| 1,277,002 | A | 8/1918 | Van Name |
| 1,363,553 | A | 12/1920 | Barringer |
| 1,475,037 | A | 11/1923 | Thimgren |
| 1,680,186 | A | 8/1928 | Von Frommer |
| 1,890,005 | A | 12/1932 | Stiennon |

(Continued)

OTHER PUBLICATIONS

KSC M17, Sep. 19, 2011, www.north-texas-airsoft.org/wiki/index.php?title=KSC_M17&oldid=1511.

(Continued)

*Primary Examiner* — Bret Hayes
*Assistant Examiner* — Derrick Morgan
(74) *Attorney, Agent, or Firm* — Thompson Coburn LLP

(57) ABSTRACT

An off-trigger locator for firearm comprises an elongated member adapted to mounted to a frame of the firearm adjacent a trigger of the firearm. The member is configured to allow a user of the firearm to sense the member with a trigger finger of the user and to move the trigger finger between the member and the trigger without significant movement of a hand of the user. The member comprises longitudinally opposite first and second ends with longitudinal sides extending between the longitudinally opposite ends. A locator surface is arranged between the longitudinal sides. The longitudinal side adjacent the trigger of the firearm forms a shoulder. The other longitudinal side is spaced from the shoulder by the locator surface. The width of the member at the shoulder is greater than the width of the member at the other longitudinal side. A method of mounting the off-trigger locator is provided.

15 Claims, 5 Drawing Sheets

(56) References Cited

U.S. PATENT DOCUMENTS

| | | | | |
|---|---|---|---|---|
| 2,058,305 | A | 10/1936 | Forsling | |
| 2,270,707 | A * | 1/1942 | Humski | 42/111 |
| D142,016 | S | 8/1945 | Birk | |
| D177,679 | S | 5/1956 | Ivy | |
| 3,065,560 | A | 11/1962 | Bumiller | |
| 3,090,123 | A | 5/1963 | Barnes | |
| 3,381,380 | A | 5/1968 | Thomas | |
| D218,931 | S | 10/1970 | Quinn | |
| 3,641,676 | A | 2/1972 | Knutsen et al. | |
| 3,698,091 | A | 10/1972 | Merrill et al. | |
| 3,901,125 | A * | 8/1975 | Raville | 89/163 |
| 4,476,644 | A | 10/1984 | Laing | |
| 4,601,123 | A | 7/1986 | Swearengen et al. | |
| 5,065,519 | A | 11/1991 | Bindon | |
| 5,359,800 | A | 11/1994 | Fisher et al. | |
| 5,426,882 | A | 6/1995 | Dornaus | |
| 5,515,636 | A * | 5/1996 | McGarry et al. | 42/117 |
| 5,560,133 | A | 10/1996 | Kuebler | |
| 5,654,594 | A * | 8/1997 | Bjornsen et al. | 307/115 |
| D416,069 | S | 11/1999 | Emerson | |
| D435,281 | S | 12/2000 | Ling, Jr. | |
| 6,216,351 | B1 | 4/2001 | Flubacher et al. | |
| D447,206 | S | 8/2001 | Ling, Jr. | |
| 6,360,471 | B1 | 3/2002 | Stein | |
| 6,363,647 | B2 * | 4/2002 | Kaminski | 42/70.11 |
| 6,388,655 | B1 | 5/2002 | Leung | |
| 6,481,137 | B2 | 11/2002 | Kornberger | |
| 6,622,412 | B1 | 9/2003 | Wilkes | |
| 6,769,210 | B2 | 8/2004 | Bubits | |
| 6,775,940 | B2 | 8/2004 | Dworzan et al. | |
| 6,860,053 | B2 * | 3/2005 | Christiansen | 42/71.02 |
| D562,931 | S | 2/2008 | Szabo | |
| D564,291 | S | 3/2008 | Zemel | |
| D565,144 | S | 3/2008 | Price | |
| 7,509,766 | B2 | 3/2009 | Vasquez | |
| D599,430 | S * | 9/2009 | Siddle et al. | D22/108 |
| D604,794 | S | 11/2009 | Bentley | |
| 7,786,397 | B2 | 8/2010 | Dick | |
| 7,832,138 | B1 | 11/2010 | Price | |
| 8,132,352 | B2 | 3/2012 | Lippard | |
| D658,263 | S | 4/2012 | Nierenberg | |
| D658,738 | S | 5/2012 | Lund | |
| 8,181,378 | B2 | 5/2012 | Losinger | |
| 8,191,301 | B2 | 6/2012 | Hatfield | |
| 8,261,481 | B1 | 9/2012 | Shebaro | |
| 8,479,433 | B1 | 7/2013 | Shebaro | |
| 8,490,311 | B2 * | 7/2013 | Hogue | 42/71.01 |
| 8,497,767 | B2 | 7/2013 | Hollis, Jr. | |
| 2002/0170224 | A1 | 11/2002 | Lawless | |
| 2002/0174585 | A1 * | 11/2002 | Fluhr et al. | 42/70.01 |
| 2002/0194767 | A1 | 12/2002 | Houde-Walter et al. | |
| 2004/0003528 | A1 * | 1/2004 | Holtzknecht et al. | 42/1.01 |
| 2004/0216348 | A1 | 11/2004 | McMoore | |
| 2005/0229457 | A1 * | 10/2005 | McGarry | 42/1.01 |
| 2006/0096147 | A1 * | 5/2006 | Gussalli Beretta | 42/71.02 |
| 2006/0156608 | A1 * | 7/2006 | Kellermann et al. | 42/71.02 |
| 2007/0240354 | A1 * | 10/2007 | Warren | 42/111 |
| 2008/0120891 | A1 * | 5/2008 | Wei | 42/90 |
| 2009/0071053 | A1 * | 3/2009 | Thomele et al. | 42/1.01 |
| 2009/0071056 | A1 | 3/2009 | Storch et al. | |
| 2010/0170138 | A1 | 7/2010 | Zukowski | |
| 2010/0225064 | A1 | 9/2010 | Deatherage, Jr. | |
| 2010/0263254 | A1 | 10/2010 | Glock | |
| 2010/0319234 | A1 | 12/2010 | Clouser | |
| 2011/0047847 | A1 | 3/2011 | Hughes et al. | |
| 2011/0107642 | A1 | 5/2011 | Godard | |
| 2011/0138667 | A1 | 6/2011 | Bolden | |
| 2011/0314721 | A1 | 12/2011 | Lamb | |
| 2012/0005930 | A1 | 1/2012 | Cragg | |
| 2012/0141957 | A1 | 6/2012 | Miller | |
| 2012/0144721 | A1 | 6/2012 | Glimpse et al. | |
| 2012/0198744 | A1 | 8/2012 | Meller et al. | |
| 2013/0000173 | A1 | 1/2013 | Green et al. | |
| 2013/0081318 | A1 | 4/2013 | Morando | |
| 2013/0104440 | A1 * | 5/2013 | Addis | 42/90 |
| 2013/0185983 | A1 | 7/2013 | Glimpse et al. | |

OTHER PUBLICATIONS

X-Treme Grips, Dec. 8, 2009, https://www.facebook.com/pages/X-TREME-GRIPS/197937916894?id=197937916894&sk=photos_stream.

Smith&WessonForums.com, Dec. 23, 2011, pp. 1-5.

* cited by examiner

OFF-TRIGGER LOCATOR

RELATED APPLICATION DATA

This application is a continuation-in-part of application Ser. No. 13/588,690, filed Aug. 17, 2012, and application Ser. No. 13/588,743, filed Aug. 17, 2012, both of which are pending; the disclosures both of which are incorporated by reference herein.

BACKGROUND

The following disclosure relates to an off-trigger locator for a firearm.

DETAILED DESCRIPTION

Figure 1:
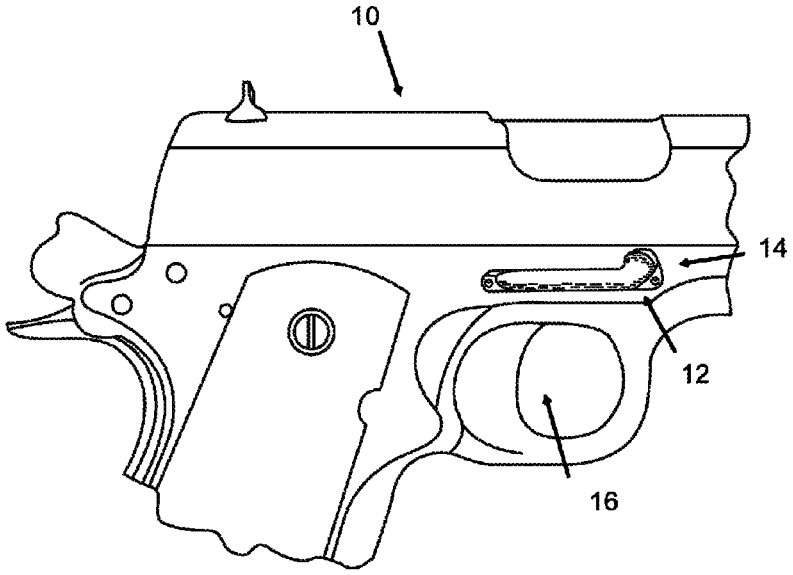
FIG. 1 is an exemplary firearm comprising a model 1911 hand gun with an off-trigger locator arranged on a right side of the hand gun.
Figure 2:
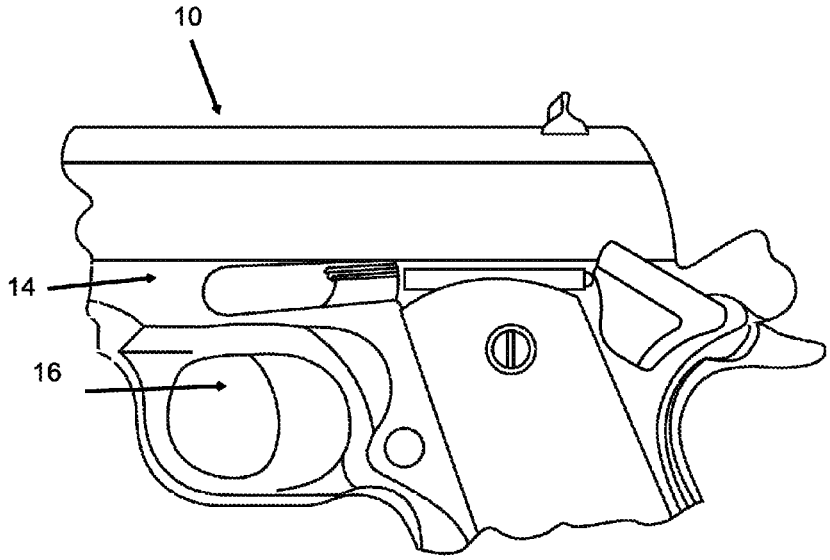
FIG. 2 is a left side view of the firearm of FIG. 1.
Figure 3:
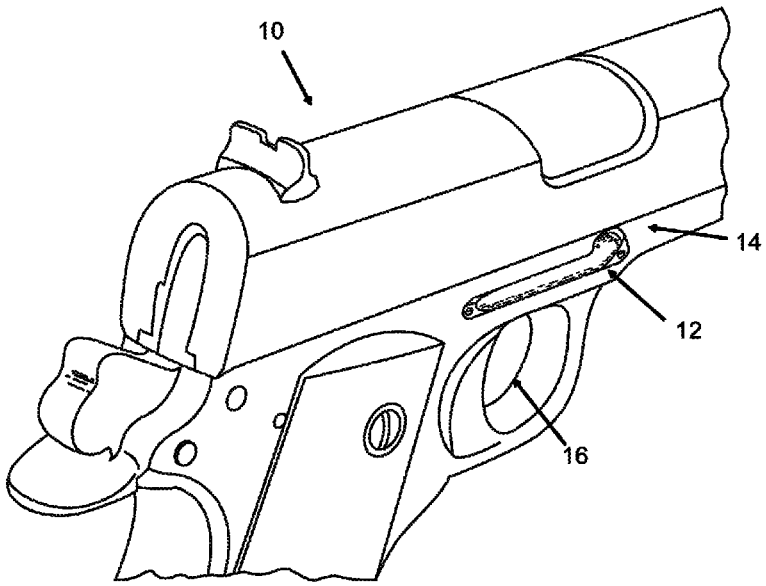
FIG. 3 is a perspective view of the hand gun of FIG. 1 with the off-trigger locator arranged on the hand gun.
Figure 4:
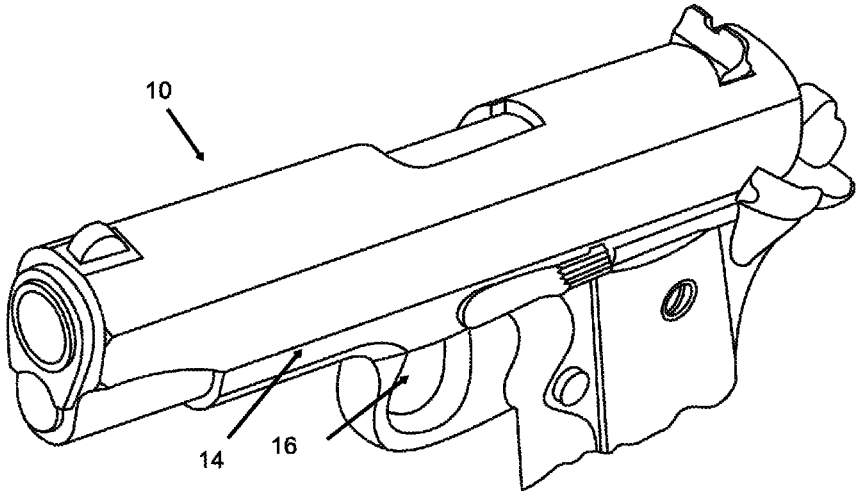
FIG. 4 is an alternate perspective view of the firearm of FIG. 1.
Figure 5:
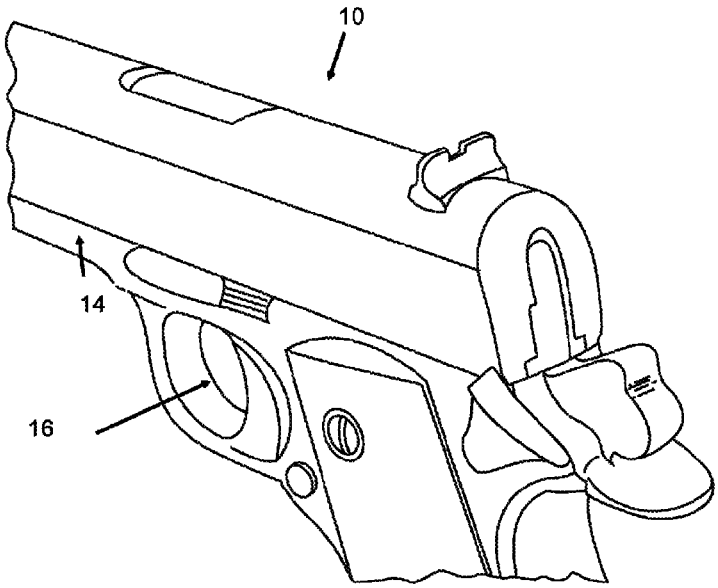
FIG. 5 is an alternate perspective view of the firearm of FIG. 1.
Figure 6:
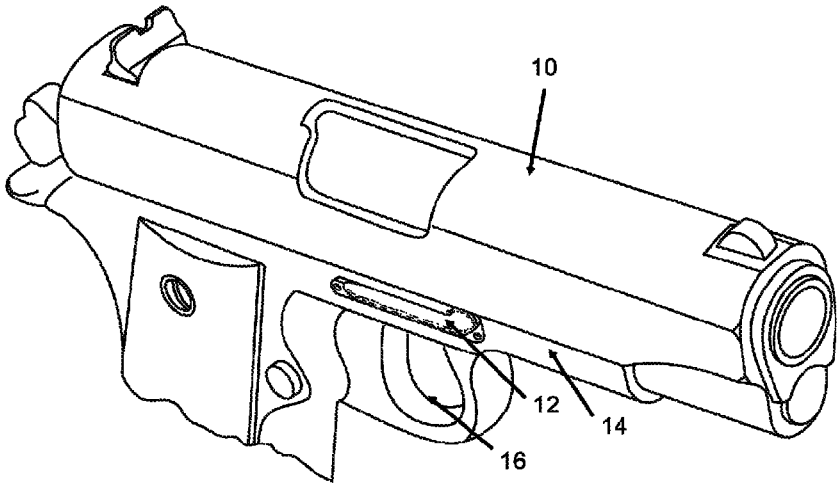
FIG. 6 is an alternate perspective view of the firearm of FIG. 1.
Figure 11:
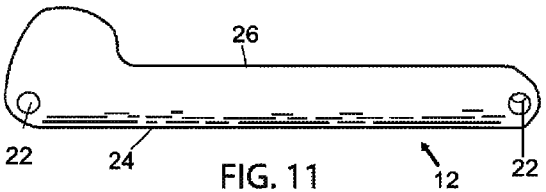
FIG. 11 is rear view of the off-trigger locator of FIG. 7 (opposite the view of FIG. 7)
Figure 12:
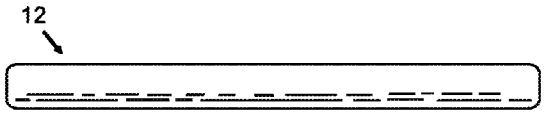
FIG. 12 is bottom view of the off-trigger locator of FIG. 7 (opposite the view of FIG. 8)
Figure 13:
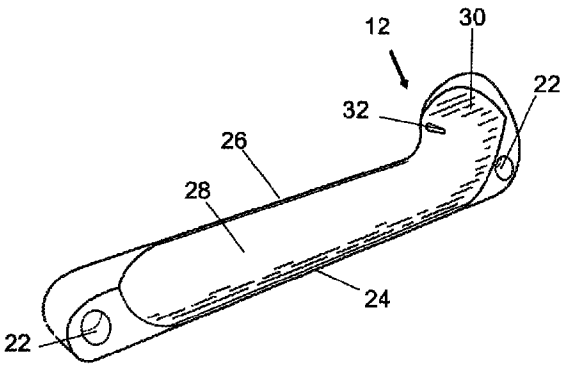
FIG. 13 is a perspective view of the off-trigger locator of FIG. 7.
Figure 10:
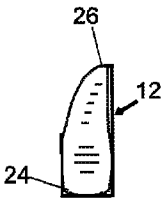
FIG. 10 is a right side view of the off-trigger locator of FIG. 7.
Figure 7:
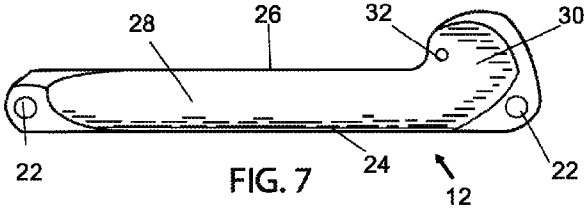
FIG. 7 is a front view of the off-trigger locator of FIG. 1.
Figure 8:
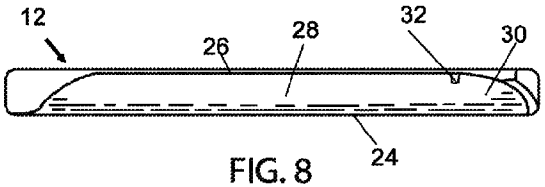
FIG. 8 is a top view of the off-trigger locator of FIG. 7.
Figure 9:
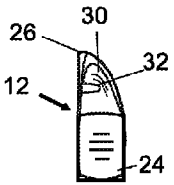
FIG. 9 is a left side view of the off-trigger locator FIG. 7.
Figure 14:
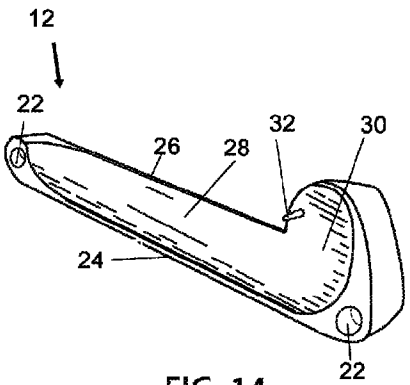
FIG. 14 is an alternate perspective view of the off-trigger locator of FIG. 7.

With reference to the drawings, a firearm 10 comprising a hand gun has an off-trigger locator 12 applied to a frame 14 of the firearm to assist the user in locating the user's trigger finger in a non-firing and firing condition. In a non-firing condition, the user may place the user's finger on the off-trigger locator 12 rather than on a trigger 16 of the firearm. Thus, the user may use the off-trigger locator 12 as a reference point rather than another location in a non-firing condition. This may prove useful in many scenarios. For instance, during training, a user may be instructed to place the user's finger on the off-trigger locator to provide a visual indication to the trainer that the user is in a non-firing condition. Providing the off-trigger locator in a standard location on the firearm also facilitates firearms training and range training by providing a quick visual aid to trainers to see that a user-trainee has complied with instructions to go to a non-firing condition. Also, an off-trigger locator provides a user with an aid to safely operate a firearm in a stressful condition. Because the off-trigger locator 12 is located in close proximity to the trigger 16, the user may disengage the off-trigger locator and engage the trigger quickly to discharge the firearm. However, the off-trigger locator requires intentional movement by the user to disengage the off-trigger locator and engage the trigger, as opposed to other locations where such movement of the user's trigger may be less intentional.

The off-trigger locator 12 is located in a position on the frame 14 of the firearm that allows the user to manipulate the user's trigger finger on the off-trigger locator while the user's trigger finger grasps a grip of the firearm. Thus, the user may continue to grasp the grip of the firearm without significant movement of the user's hand as the user sensors the off-trigger locator with the user's trigger finger. However, the off-trigger locator 12 is in a position on the frame 14 of the firearm that allows the user to easily move between the off-trigger locator and the trigger, as necessary, for instance, as the user goes between a non-firing and firing condition.

FIGS. 7-14 show an embodiment of the off-trigger locator 12 as an attachment to be applied to the frame of the firearm. Alternatively, rather than as an attachment, the frame of the firearm may be cast with the off-trigger locator formed therein. For instance, the off-trigger locator may be formed monolithically with the frame of the firearm. The off-trigger locator 12 comprises an elongate member or protuberance. Attachment holes 22 for mechanical fasteners may be located on longitudinally opposite ends of the elongate member. Alternatively, the attachment holes may be omitted, for instance, if the off-trigger locator is adhered, brazed or soldered to the frame, or otherwise formed integral with the frame. A shoulder portion 24 (toward the bottom of the member in FIG. 7) of the elongate member or protuberance has a prominent thickness, and on the opposite longitudinal side of the attachment, an edge 26 is provided (towards the top of the member in FIG. 8). A locator surface 28 may be provided between the shoulder portion 24 and the edge 26 and between the longitudinally opposite locator holes 22. The shoulder portion 24 may be stepped or as shown in the drawings smoothly tapered to the locator surface 28. The locator surface 28 may extend without significant transition to the edge 26. The locator surface 28 may be angled or as shown in the drawings smoothly radiused. The elongate member may be formed with bosses on its longitudinally opposite ends to accommodate the attachment holes, if attachment holes are provided.

Preferably, the off-trigger locator 12 has a smooth transition between the edge 26 and the frame 14 of the firearm. On the opposite longitudinal edge, the shoulder portion 24 provides a tactile location for the user to locate their trigger finger while in a non-firing condition. Preferably, the shoulder portion 24 is of sufficient thickness of width or prominence to require the user to intentionally move his or her trigger finger from a non-firing condition to a firing condition. Preferably, the off-trigger locator 12 is arranged is adjacent the trigger area 16 of the firearm so the user may slide their finger over the shoulder portion 24 into the trigger area to engage the trigger in a firing condition.

To assist the user in locating their trigger finger in a non-firing condition, the off-trigger locator 12 may have an enlarged depression area 30 formed at one longitudinal end of the elongate member or protuberance. The depression area 30 may be circular and the locator surface 28 may be integrated with the depression area 30 without significant transition between the two surfaces thereby providing a seemingly continuous smooth surface from the shoulder portion 24 to the edge 26 from one longitudinal end of the off-trigger locator to the opposite longitudinal end. The depression area 30 may have a raised dot or tick 32 in the center of the depression area to assist the user in finding the depression on the side of the frame of the firearm. In the drawings, the depression area is formed on the right hand side of the locator surface (FIG. 7) so that it can be mounted to the right side of the frame of the fire arm for a right hand dominant user. The position of the depression may be reversed when the off-trigger locator is to be placed on the left side of the frame of the firearm for a left hand dominant user.

The off-trigger located may be provided on one or both sides of a single arm or the left or right side depending upon the dominant hand of the user and the style of firearm. While the drawings show a hand gun, the attachment may be used and applied to any weapon system-firearm with a trigger. The drawings are not intended to be limiting in any sense.

Figure 15:
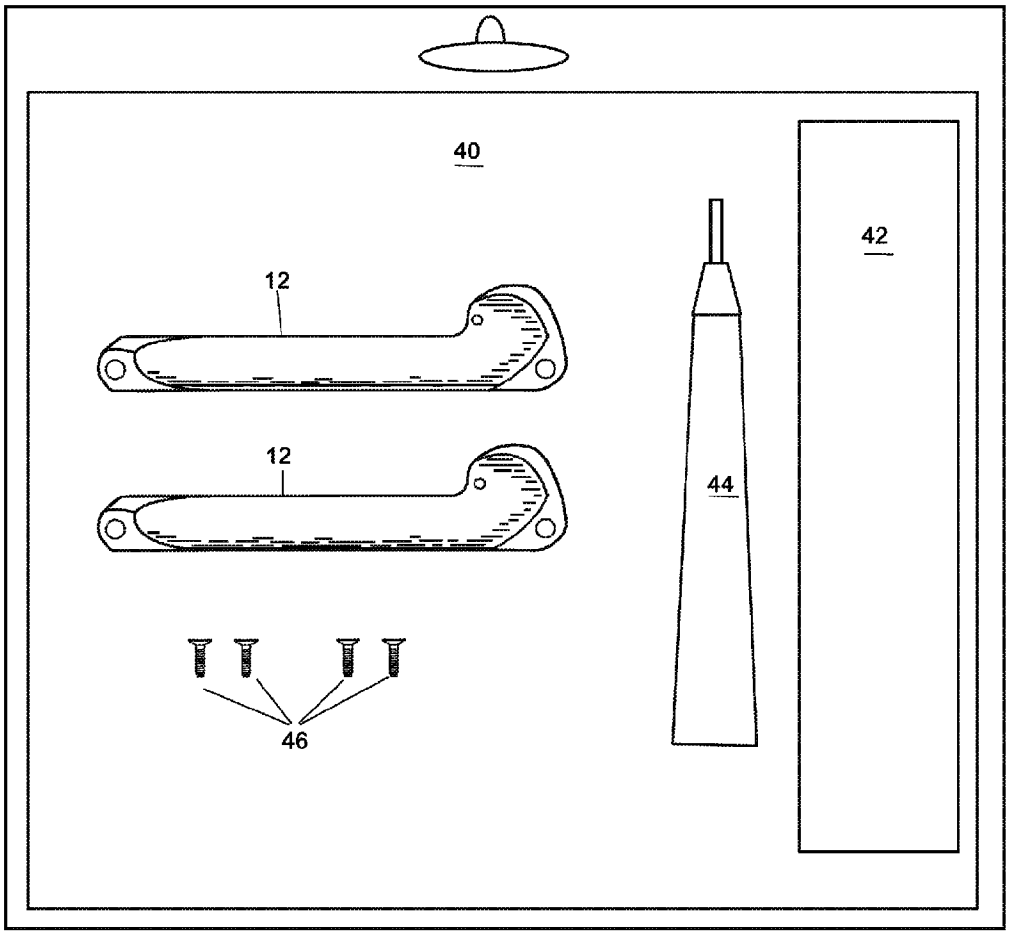
FIG. 15 is a plan view of a kit comprising an off-trigger locator attachment that may be applied to a firearm.

As shown in FIG. 15, the off-trigger locator 12 may be provided as a kit 40. For instance, the off-trigger locator 12 may be provided as an attachment that may be provided as a kit to retrofit an existing firearm. The kit 40 may contain instructions or other indicia 42, and other items 44, for applying the attachment of the kit to the firearm. The off-trigger locator 12 of the kit may be mechanically attached with fasteners 46. The off-trigger locator may also be adhered, soldered, brazed, or welded to the firearm. The kit shows a representative configuration. Other shapes and configurations may be used.

Rather than providing as a kit, the frame of the firearm may be cast with the off-trigger locator formed therein. For instance, the off-trigger locator may be formed monolithically with the frame of the firearm. The off-trigger locator may comprise a deposition of metal (i.e., plasma spray, weld bead) or other sprayed coating that is applied to the frame of the firearm, and which may be machined after application to form the off-trigger locator. Alternatively, the off-trigger locator may be machined in the side of the frame of the firearm, or the combination of a depression in the frame and a protuberance projecting from the frame, so that it forms an off-trigger locator feature with the features explained above.

The embodiments were chosen and described in order to best explain the principles of the invention in its practical application to thereby enable others skilled in the art to best utilize the invention in various embodiments and with various modifications as are suited to the particular use contemplated. As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A firearm comprising an off-trigger locator, the off-trigger locator comprising an elongated raised portion on a frame of the firearm adjacent a trigger of the firearm, the elongated raised portion being fixed in position and non-movable on the frame of the firearm, the raised portion being configured to allow a user of the firearm to sense the raised portion with a trigger finger of the user and to move the trigger finger between the raised portion and the trigger without significant movement of a hand of the user, the raised portion comprising longitudinally opposite first and second ends with longitudinal sides extending between the longitudinally opposite ends and a locator surface arranged between the longitudinal sides, one of the longitudinal sides being adjacent the trigger of the firearm and having a shoulder, the other of the longitudinal sides being spaced from the shoulder by at least a portion of the locator surface, the shoulder projecting away from the frame of the firearm a distance that is greater than a distance that the other of the longitudinal side projects away from the frame of the firearm, wherein the locator surface comprises a circular depression, and wherein the circular depression has a raised dot configured to allow the user of the firearm to sense the raised dot with a trigger finger of the user.

2. The firearm of claim 1, wherein the longitudinal side opposite the shoulder has an edge providing a smooth transition to the frame of the firearm from the locator surface.

3. The firearm of claim 1, wherein the raised portion is formed monolithically with the frame of the firearm.

4. The firearm of claim 1, wherein the raised portion is adhered to the firearm.

5. The firearm of claim 1, wherein the off-trigger locator comprises a kit associated with the firearm.

6. The firearm of claim 1, wherein the raised portion has attachment holes on its longitudinally opposite ends.

7. The firearm of claim 1, wherein the locator surface comprises a smoothly curved surface extending between the longitudinal sides.

8. An off-trigger locator for firearm, the off-trigger locator comprising an elongated member adapted to be mounted to a frame of the firearm adjacent a trigger of the firearm, the elongated raised portion being fixed in position and non-movable on the frame of the firearm, the member being configured to allow a user of the firearm to sense the member with a trigger finger of the user and to move the trigger finger between the member and the trigger without significant movement of a hand of the user, the member comprising longitudinally opposite first and second ends with longitudinal sides extending between the longitudinally opposite ends and a locator surface arranged between the longitudinal sides, one of the longitudinal sides being adjacent the trigger of the firearm and forming a shoulder, the other of the longitudinal sides being spaced from the shoulder by at least a portion of the locator surface, a width of the member at the shoulder being greater than a width of the member at the other of the longitudinal side, wherein the locator surface comprises a circular depression, and wherein the circular depression has a raised dot configured to allow the user of the firearm to sense the raised dot with a trigger finger of the user.

9. The off-trigger locator of claim 8, wherein the longitudinal side opposite the shoulder has an edge providing a smooth transition to the frame of the firearm from the locator surface when the off-trigger locator is mounted to the firearm.

10. The off-trigger locator of claim 8, wherein the off-trigger locator comprises a kit associated with the firearm.

11. The off-trigger locator of claim 8, wherein the member has attachment holes on its longitudinally opposite ends.

12. The off-trigger locator of claim 8, wherein the locator surface comprises a smoothly curved surface extending between the longitudinal sides.

13. A method comprising:

accessing a frame of a firearm; and applying an off-trigger locator to the frame of the firearm adjacent a trigger of the firearm, the elongated raised portion being applied in a fixed position and non-movable on the frame of the firearm, the off-trigger locator comprising an elongate member with longitudinally opposite first and second ends with longitudinal sides extending between the longitudinally opposite ends and a locator surface arranged between the longitudinal sides, one of the longitudinal sides forming a shoulder, the other of the longitudinal sides being spaced from the shoulder by at least a portion of the locator surface, a width of the member at the shoulder being greater than a width of the member at the other of the longitudinal side;

wherein the step of applying includes arranging the shoulder of the member to be adjacent to the trigger of the firearm, and in a manner such that a user of the firearm is enabled to sense the member with a trigger finger of the user and to move the trigger finger between the member and the trigger without significant movement of a hand of the user, wherein the locator surface comprises a circular depression, and wherein the circular depression has a raised dot configured to allow the user of the firearm to sense the raised dot with a trigger finger of the user.

14. The method of claim 13, wherein the step of applying includes mounting the off-trigger locator to the frame of the firearm.

15. The method of claim 13, wherein the step of applying includes orienting the member in a manner such that the user is enabled to sense the depression with the trigger finger of the user.

* * * * *